United States Patent [19]

Kimura

[11] Patent Number: 5,026,195

[45] Date of Patent: Jun. 25, 1991

[54] FLUID APPLICATION TOOL WITH CONVEX SPACERS

[75] Inventor: Masaru Kimura, Gunma, Japan

[73] Assignee: Mitsubishi Pencil Co., Ltd., Tokyo, Japan

[21] Appl. No.: 450,941

[22] Filed: Dec. 15, 1989

[30] Foreign Application Priority Data

Jan. 9, 1989 [JP] Japan ..... 1-1130

[51] Int. Cl.[5] ..... A46B 11/00

[52] U.S. Cl. ..... 401/283; 401/278; 401/279; 401/273

[58] Field of Search ..... 401/273, 199, 283, 279, 401/278

[56] References Cited

U.S. PATENT DOCUMENTS 3,774,230 11/1973 Tullos ..... 401/198 X
4,408,921 10/1983 Nagai ..... 401/199 X

FOREIGN PATENT DOCUMENTS 1016052 8/1952 France ..... 401/273
2173743 10/1986 United Kingdom ..... 401/273
2176393 12/1986 United Kingdom ..... 401/273

*Primary Examiner*—Steven A. Bratlie
*Attorney, Agent, or Firm*—Armstrong, Nikaido, Marmelstein, Kubovcik & Murray

[57] ABSTRACT

A fluid application tool having a gap provided between the rear end of an immersion substance temporarily storing applied fluid to be supplied to application material and the edge of a fluid exit of an immersion substance support abutted on the immersion substance by forming convexes on the front edge portion of the immersion substance support surrounding the exit.

1 Claim, 3 Drawing Sheets

FLUID APPLICATION TOOL WITH CONVEX SPACERS

BACKGROUND OF THE INVENTION

1. Field of the Invention

The present invention relates to a tool for applying fluids such as writing ink, correction liquid, make-up liquid, hair dye, paint, liquid adhesion, and liquid medicine. In the invention, it is assumed that writing materials are also included in the application tool.

2. Prior Art

In a conventional fluid application tool which is configured so that fluid is passed from a reservoir tank through an induction tube to an immersion substance located at the front end of the induction tube and then supplied to an application material, the air replacing the fluid follows a reverse path from the immersion substance to the reservoir tank through the induction tube to adjust the internal pressure of the tank. However, the conventional fluid application tool has such a structure that the rear end of the immersion substance abuts on the edge of the fluid exit located at the front end of the induction tube without a gap or, the flat rear end (see FIGS. 5 and 6) of the immersion substance 3 abuts without any gap on the edge of the fluid exit located on the immersion substance support 7 inserted as shown in FIGS. 5 and 6 between the immersion substance 3 and the induction tube 2. Accordingly such structure may often cause the fluid fed out from the fluid exit 5 to the immersion substance 3 to go back with the air when the air enters from the immersion substance 3 to the induction tube or the fluid exit 5 located on the immersion substance support. Therefore, in order to accumulate the required amount of fluid enabling the immersion substance 3 to supply the fluid to the application material 4, it is necessary to perform trivial operation such as repetition of multiple knock operations to feed the fluid sufficiently.

The present invention is inteded to make trivial operations such as repetition of multiple knock operations to feed fluid unnecessary by providing such a fluid application tool that it is difficult for the fluid sent out from the fluid exit to the immersion substance to go back with the air when the air enters from the immersion substance to the fluid exit of the immersion substance support placed in contact with the flat rear end of the immersion substance.

SUMMARY OF THE INVENTION

The present invention provides a fluid application tool so configured that fluid to be applied is passed from a reservoir tank through an induction tube to air-permeable immersion substance located at the front end of the induction tube and then to an application material, a gap being provided between the edge of a fluid exit of an immersion substance support abutting on the immersion material and the rear end of the immersion material by plural convexities formed surrounding the edge on the immersion substance support.

BRIEF DESCRIPTION OF THE DRAWINGS

FIG. 1 is a cross section of the entire tool,

FIG. 2 is a cross section of a tip portion taken at a position with the tool rotated by 90 degrees around its longitudinal axis from the view of FIG. 1.

FIG. 3 is a front view of an immersion substance support

FIG. 4 is a side view of an immersion substance support of the hair dye application tool of FIG. 1, FIG. 5–8 show a conventional hair dye application tool.

DETAILED DESCRIPTION AND THE PREFERRED EMBODIMENT

Figure 1:
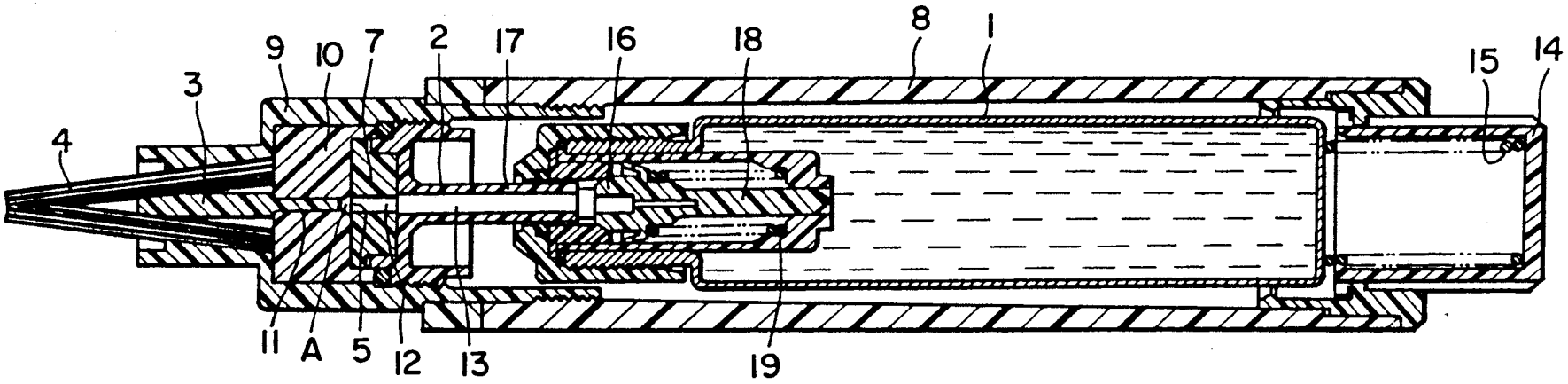
FIGS. 1–4 show a hair dye application tool according to the present invention.
Figure 2:
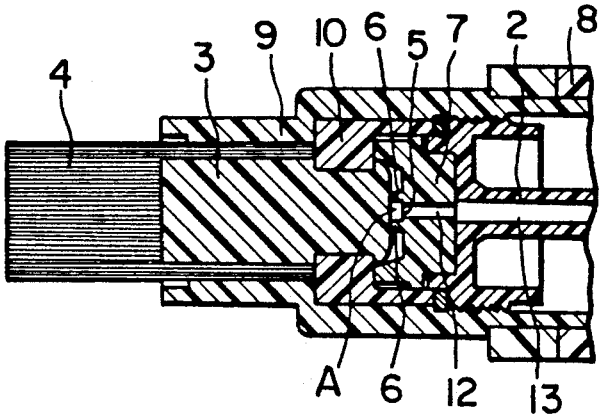
Figure 3:
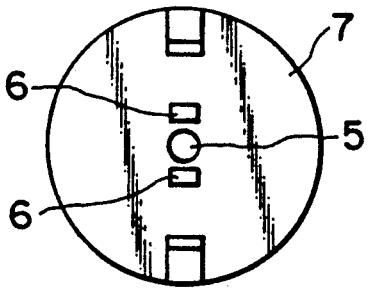
Figure 4:
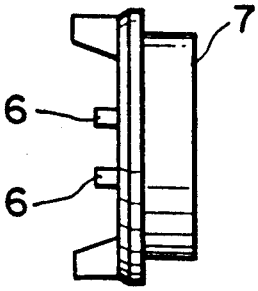
Figure 5:
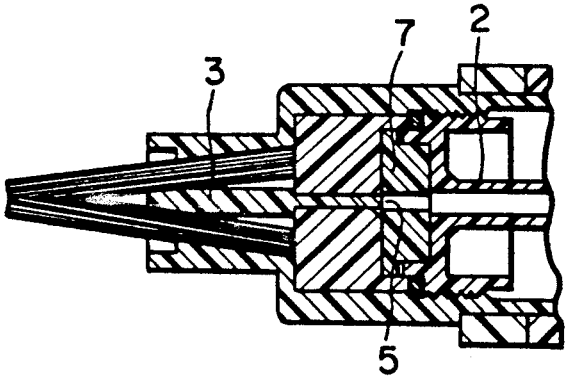
FIG. 5 PRIOR ART
FIG. 5 is a cross section of a tip portion.
Figure 6:
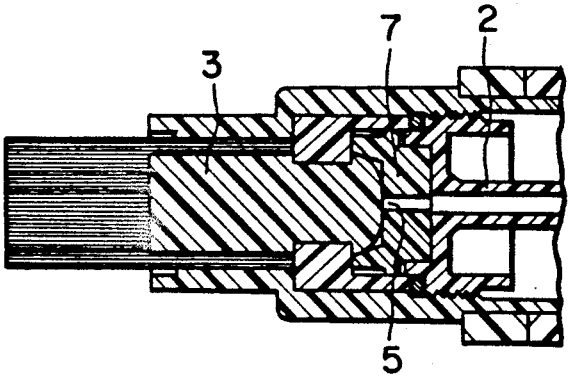
FIG. 6 PRIOR ART
FIG. 6 is a cross section of the same taken at a position with the tool rotated by 90 degrees around its longitudinal axis from the view of FIG. 5.
Figure 7:
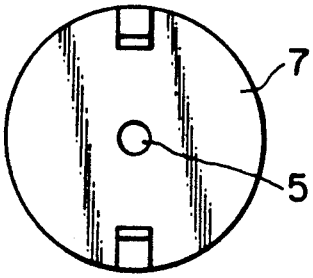
FIG. 7 PRIOR ART
FIG. 7 is a front view of an immersion substance, support
Figure 8:
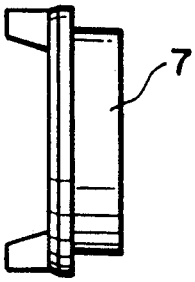
FIG. 8 PRIOR ART
FIG. 8 is a side view of the immersion substance support.

The present invention will be described in detail referring to FIGS. 1–4 showing a hair dye application tool according to the present invention but it is not limited to such embodiment.

An end shaft 9 is screwed on the front end of a main shaft 8, a pedestal 10 is fixed within the end shaft 9, and a brushy application material 4 consisting of bundles of fiber is planted on the front side of the pedestal 10 in an inclined posture with its tip coming together to the center line of the end shaft. The tip the application material 4, of projects forward over the end opening along the end shaft.

A through-hole 11 is bored in the center of the pedestal 10 and a sponge immersion substance 3 is provided penetrating the through-hole 11.

The front half of the immersion substance 3 projects forward over the pedestal 10 with its side contacting with the inclined application material 4 described above.

An immersion substance support 7 is placed in the rear of the pedestal 10. The center of the immersion substance support 7 has a through-hole 12 whose front end constitutes a hair dye exit 5. On the front edge portion of the hair dye exit 5 are provided two convexities 6 surrounding the exit 5. The rear end of the immersion substance 3 abuts on the convexities 6. Therefore, the convexities 6 produce a gap A between the rear end of the immersion substance 3 and the hair dye exit 5. Due to the existance of the gap A, it is difficult for the hair dye to go back from the hair dye exit to the immersion substance together with the air when the air passes from the immersion substance to the hair dye exit. Thus it is easy for the immersion substance to accumulate a required amount of hair dye to be supplied to the application material with only a few operations, which improves the usability of the tool.

The rear end of the immersion substance support 7 abuts on the front end of the induction tube 2, and the through-hole 12 of the immersion substance support 7 communicates with the induction hole 13 of the induction tube 2. The induction tube 2 is screwed on the inside of the end shaft 9. A cartridge-type hair dye reservoir tank 1 is axially movably received in the main shaft 8. A knock bar 14 is provided at the rear of the reservoir tank 1 penetrating toward the rear of the main shaft 8 through a knock spring 15.

A valve unit 16 is mounted in the inside of the front end aperture of the reservoir tank 1, and a rear end pipe portion 17 of the induction tube 2 is inserted into the reservoir tank 1 through a front end opening to abut on a valve bar 18.

Pressing the knock bar 14 forward, the reservoir tank 1 is advanced to the pipe 17 of the induction tube 2 but the valve bar 18 cannot be moved due to abutment on the pipe 17, and accordingly the valve bar 18 moves back relatively in the valve unit 16 to enable the hair dye to flow into the space forward against the valve bar 18. Next, if the knock pressure is released, the pressure of the valve spring 19 in the valve unit 16 causes the reservoir tank 1 to move back relatively to the pipe 17 of the induction tube 2, and thus the valve bar 18 moves forward relatively to the reservoir tank 1, which enables the hair dye in the space before the valve bar 18 to be pressed into the pipe 17 of the induction tube 2. In this status, only a small negative pressure appears in the reservoir tank 1. The hair dye entering into the induction tube 2 is led to the through-hole 12 of the immersion substance support 7 through the induction hole 13 and then fed to the immersion substance 3 from the hair dye exit 5. Next, pressing the knock bar again, the negative pressure in the reservoir tank 1 causes fresh air to be pulled into the reservoir tank through the immersion substance 3, and releasing the knock pressure, the hair dye is fed to the immersion substance 3 as described above. If the hair dye accumulated in the immersion substance 3 reaches to a required amount by repeating the above operations several times, then it is sent from the immersion substance 3 to the application material 4.

What is claimed is:

1. A fluid application tool so configured that fluid to be applied is passed from a reservoir tank through an induction tube to an air-permeable immersion substance located at the front of the induction tube and then to an application material, characterized by a gap A provided between the front edge of a fluid exit of the immersion substance support and the rear end of the immersion substance abutted on the immersion substance support, said gap being formed by convexities on the front edge portion of the immersion substance support surrounding the exit.

* * * * *